United States Patent [19]

Wilkinson et al.

[11] 4,416,389

[45] Nov. 22, 1983

[54] RETAINED TAB EASY OPEN END (SMALL POUR HOLE)

[75] Inventors: Harlen E. Wilkinson, Crystal Lake; Fred W. Wren, Addison, both of Ill.

[73] Assignee: American Can Company, Greenwich, Conn.

[21] Appl. No.: 436,858

[22] Filed: Oct. 26, 1982

[51] Int. Cl.[3] ..... B65D 41/32

[52] U.S. Cl. ..... 220/269; 220/270; 220/72

[58] Field of Search ..... 220/269, 270, 272, 273, 220/72, 66

[56] References Cited

U.S. PATENT DOCUMENTS

| | | | |
|---|---|---|---|
| 3,957,172 | 5/1976 | Hasegawa | 220/269 |
| 4,210,257 | 7/1980 | Radtke | 220/269 |
| 4,219,127 | 8/1980 | Bielicki | 220/269 |
| 4,361,251 | 11/1982 | Langseder et al. | 220/269 |
| 4,387,827 | 6/1983 | Ruemer, Jr. | 220/269 |

*Primary Examiner*—Joseph Man-Fu Moy

*Attorney, Agent, or Firm*—Paul R. Audet; Aaron Passman

[57] ABSTRACT

Shown is an easy open closure for a container wherein there is a ring-pull tab held by an integral rivet to the central circular recessed panel of the closure. The tab however, rests on a raised portion of that panel which portion includes various areas of weakening and strengthening and a displaceable panel therein defined by a score line. The raised portion positions the tab to protect it against abuse loadings due to handling and shipping full containers having the closure. About the periphery of the central circular panel is a stepped wall portion except near the area of the score line for the displaceable panel where the wall is unstepped.

8 Claims, 4 Drawing Figures

RETAINED TAB EASY OPEN END (SMALL POUR HOLE)

BACKGROUND OF THE INVENTION

The market for metal containers has developed due in part to the introduction of the easy open end. While the easy opening feature has been shown to be both effective and convenient, it has given rise to a collateral problem of littering, since traditionally the easy opening tab was pulled free from the container to expose the contents and then subsequently discarded. The indiscriminate disposal of the pull tabs is not only unsightly, but can also present a safety hazard particularly on beaches and in parks. Further, the relatively small size of the separated tab on beverage containers presents a challenge to those concerned with the collection and recycling of waste material. The solution to this problem resides in a nondetachable tab and preferably a tab which is of compatible material with the end closure and is therefore recyclable.

While the industry has addressed this problem by developing a number of closure structures, one of the more successful has been a can end which employs a retained ring-pull tab. In this structure, the tab is joined to the container end by a rivet which carried upon a scored displaceable panel in the end panel that serves as the pour opening of the container end. Typically, the ring-pull of the tab has an aperture to receive a rivet that is an integral part of the center panel of the end closure. Since the tab functions to permit the breaking and tearing of the scored portion of the end panel about the rivet it must be sufficiently rigid to prevent distortion of the area about its aperture when pulling force is applied to the lift end of the tab to effect rupture and displacement of the scored portion.

For many years full panel easy open end structures were made to permit the removal of substantially all of the central portions of an end panel closure. These arrangements included a ring pull tab with a tab nose and a tab lift connected by a central web usual apertured to receive the integral rivet for the end panel rupture and then lifting. The ring pull or tab lift would fracture the score in the area adjacent the tab nose end pulling the ring pull or tab lift would tear the scored panel and remove or displace same from the end. Such an approach was fine except that the portion removed was not retained and would not overcome the litter problem. Similarly, retained tabs or ring-pull tabs provided with small openings, for beverage containers in particular, and the ring-pull have an integral rivet arranged so that the break would occur thereabout as the displaceable panel defined by a score was removed from the can. The combination of a pour opening concept based upon the full panel concept and the retained tab concept has not been used. More particularly, to some extent retained tabs of the type just described are similar to full panel opening ends in that the ring-pull is first lifted to rupture or break the scored portion near the periphery and then the ring-pull is yanked radially across the end to open while tearing along the score and folding back the tab but the foldback is uncertain. The scored displaceable panel is unconventional in that it defines a small pour opening and not a removable full panel. In fact, there remains a hinge portion which is unscored to retain the pulled displaceable panel and the terminations of the score about the hinge portion are curved away from each other to discourage further tearing.

A problem however arises when packaging noncarbonated beverages with such closures; that is to say that, the internal support for the end closure is not provided by the pressure of the product packed within the container. Therefore, the loads imposed when filling and after packing must be withstood entirely by the construction and design of the end. Approaches which have been tried using the retained ring-pull approach have hailed because fatigue and loadings during handling and shipping of the filled containers. More specifically, containers filled with gas and oil additives and the like which are not carbonated) that have to be easily poured into openings on an automobile that are sometimes difficult to reach require a container with a pour opening adequate to handle the viscosity of the material and to direct the flow of same toward those difficult to reach places for filling. Enlarged pour openings defined by scoring tend to further weaken the easy opening end and magnify the problems of failure.

It is, therefore, an object of the invention to provide an easily opened retained tab end closure with a pour opening of sufficient shape and size to permit dispensing of noncarbonated material.

It is yet another object of the invention to provide a ring-pull retained tab end closure with a displaceable panel adequately fashioned to resist fatigue and static loadings.

SUMMARY OF THE DISCLOSURE

In order to overcome the problems of easily opened ring-pull tab end closures for noncarbonated materials an improved end design has been developed. More specifically, there is disclosed an easy open end closure the hollow cylindrical thin walled container bodies used to package oil and gas additives. That end closure includes a displaceable panel defined by a score to enable opening of same without need of extra equipment or tools. The displaceable panel is shaped so as to provide a convenient and adequate pour opening for use in dispensing oil and gas additive materials into the various recesses and receptacles. To remove the displaceable panel there is provided a tab having a tab nose and a tab lift with a web of material therebetween. The web is apertured to receive an integral rivet positioned in the displaceable panel and extending outwardly of the container. The rivet is staked in the aperture to retain the tab to the displaceable panel such that the tab nose is adjacent the area of the score nearest one end of the end panel. Specifically, the end panel has a circular center panel which is defined by a stepped annular wall extending perpendicularly to the periphery of the central panel and outwardly of the container. In the area adjacent the score near the annular wall the stepping thereof is omitted such that the wall is straight and not offset outwardly as it extends away from the central end panel. The tab lift includes a ring-pull and the tab nose is re-enforced such that lifting of the tab ruptures the score adjacent the unstepped portion of the annular wall and pulling the tab tears the ruptured displaceable panel outwardly as the tab is pulled across the central panel. Thus, the displaceable panel is folded back upon itself leaving a pour opening adequate to dispense the oil and gas additives. The configuration of the score is generally U-shaped with the open mouth of the U disposed toward the center of the central panel and each leg of the U curved away from the mouth. The bight of the U is adjacent the unstepped portion of the annular wall. There is a line of weakness (being moustache-shaped score) at the area between the mouth of the U-shaped score located adjacent the rivet. This moustache score is to faciliate the lifting and rupture of the displaceable panel.

To enhance the resistance to fatigue and static loadings, The end panel includes a raised portion which extends from the unstepped portion of the annular wall across the central panel just past the middle thereof. The raised portion defines a stage or platform where the displaceable panel, integral rivet and the ring-pull tab reside. The raised portion in combination with the unstepped and stepped portions of the annular wall cooperate to overcome fatigue and static loadings which must be carried by the central end panel as there is no internal pressure from the carbonation.

BRIF DSCRIPTIN OF TE DAWINS

FIG. 1 is a top plan view of an easy open closure for a container before the closure has been applied to the container or been opened, FIG. 2 is a bottom plan view of the closure of FIG. 1, FIG. 3 is an enlarged side cross-sectional view taken along line 3—3 of FIG. 1 and showing the relationship of the tab end closure, and the relationship of the tab end closure, and FIG. 4 is a top plan view of the closure of FIG. 1 where the easy open tab has been pulled and lifted to open the pour hole. The various positions of tab movement during the preliminary folding back are shown in phantom and full lines.

DETAILED DESCRIPTION OF THE DRAWINGS

Figure 1:
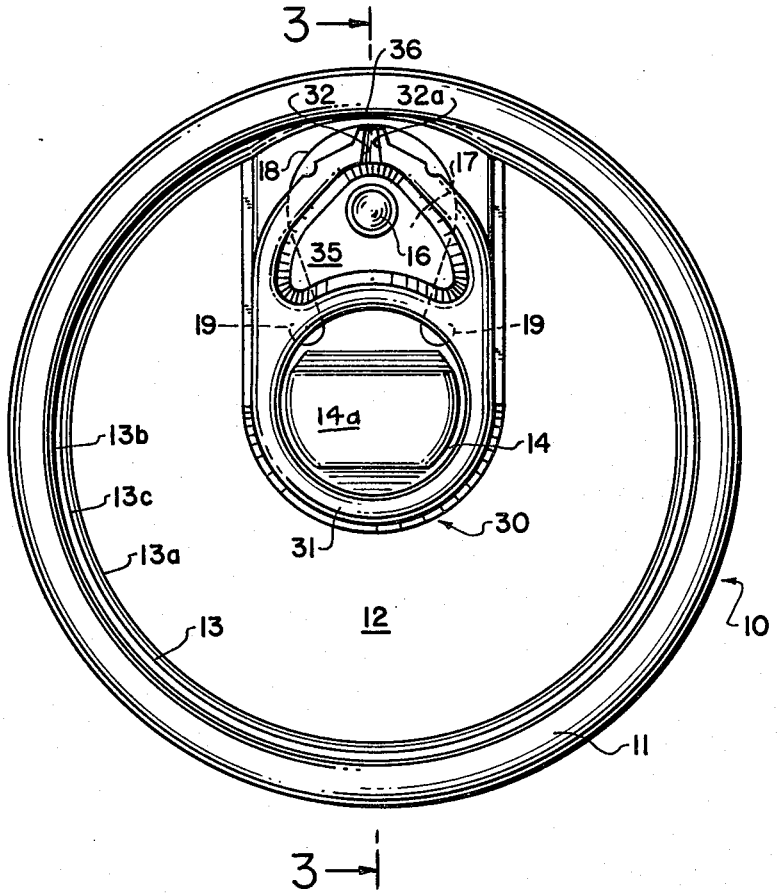

FIG. 1 is a top plan view of an easy open end closure 10 for a container. The closure 10 carries a ring pull tab 30 the details of which will be described after the specifics of the end 11 are explained. In particular, end 11 included a recessed central panel 12 of circular configuration bounded by a stepped wall 13 composed of a lower portion **13*a* and an outwardly disposed upper portion 13*b*, FIG. 3. Both portions being normal to the plane of panel 12 with portion 13*a* joining at the periphery of panel 12 and portion 13*b* connecting to upper portion 13*a* by offset 13*c*. A raised portion 14 is set into panel 12 and extends from the periphery of panel 12 at one side toward and across the center thereof to form a stage for supporting and carrying tab 30, see FIGS. 1 and 3**.

Raised portion 14 is greatly worked and formed for purposes of strength and control during the operation of end 11 as an easy open closure. That is to say that, the operation of the tab 30 is greatly defined by the various detail formed and scoring on raised portion 14. Also there is an anti-rotation feature in an additional raised section **14*a* on the raised portion 14. Raised section 14*a*** conjugates with the tab ring pull opening to prevent rotation.

Figure 2:
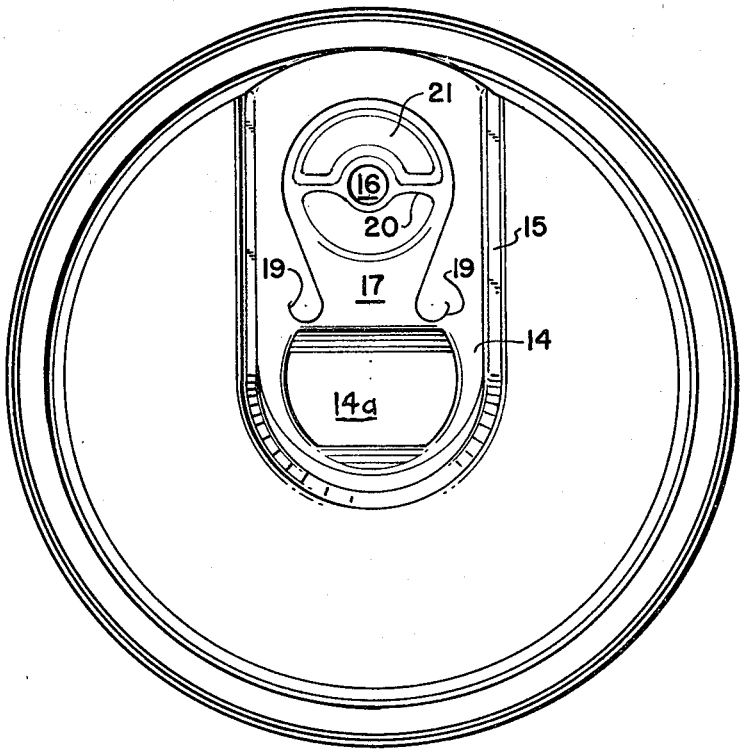

Specifically, raised portion 14 rests on an inclined wall 15 which surrounds it and connects it to the central panel 12. As best seen from the bottom plan view of FIG. 2, the raised portion 14 has an integral rivet 16 which is formed initially as an upstanding straight walled closed cylinder shaped and is thereafter staked over tab 30 (shown in cross-section in FIG. 3). Rivet 16 is centered in a generally U-shaped displaceable panel 17 which is defined by its score line 18. Score line 18 has a bight positioned near the side of panel 12 adjacent the wall 13 but located on raised portion 14. The U-shaped displaceable panel 17 is generally curvilinear such that the score line 18 extends from the bight to a pair of opposed legs which angle toward one another and terminate in equal but opposite reverse curves 19 which turn outwardly forming a mouth of the U FIG. 2. Thus, the displaceable panel 17 as defined by score line 18 is such that when torn from raised portion 14 by means of tab 30 the opening remaining in raised portion 14 of panel 12 is of any easy pouring configuration having the generally U-shape of the score line 18. More particularly, the pour opening is larger in the base of the U near the bight than at the mouth of the U.

To aid in the process of opening the closure 10 there are areas weakness provided about rivet 16. Specifically, in FIG. 2, there is a curved line 20 shown from the bottom as an embossed mark resulting from the scoring of same on the top of closure 10. Curved line 20 cannot be seen in FIG. 1 because the tab 30 covers the area where line 20 is scored. The shape of the curved line 20 is such that it wraps about rivet 16 and extends transversely away therefrom partially across the U-shaped displaceable panel 17. The extended ends of curved line 20 reversely curve (in the opposite direction) from the curve of the line 20 near rivet 16 so as to form the shape of an upside down handle bar moustache (FIG. 2) hence the term moustache score has been applied to same.

Figure 3:
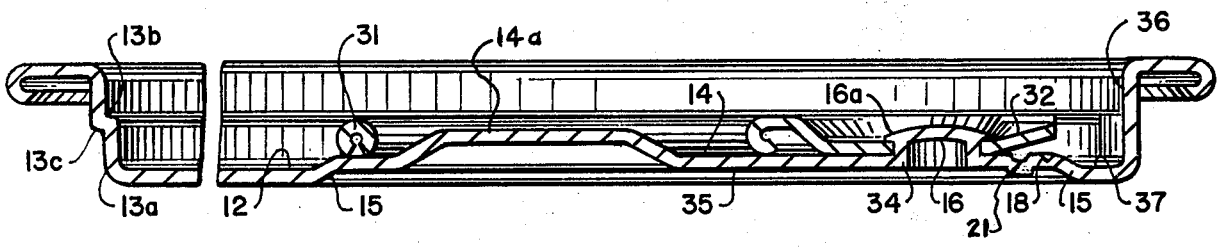

On the opposite side of rivet 16 across from the curved line 20 there is a reinforcing crescent 21 in the form of a recess stamped in the raised portion 14. Thus, it can be seen that the moustache score line 20 and the re-enforcing crescent 21 acts in combination to ensure that the tab 30 is able to rupture the score 18 to facilitate the tearing. Specifically, the tab 30 is composed of a lift end 31 and a tab nose 32; lift end 31 includes a ring-pull opening 33 which is made by punching and curling under the tab stock as best shown in FIG. 3. Consequently, the ring-pull opening 33 is smooth to the touch of the user. There is an aperture 34 provided to receive the integral rivet 16 such that same may be staked under the portion **16*a* of rivet 16 to hold tab 30 against the raised portion 14. Aperture 34 is provided in a web portion 35 of the tab 30 such that the rivet 16 is positioned close to the tab nose 32 than it is to the tab lift 31 whereby a mechanical advantage is provided when the tab lift 31 is used to first rupture the score line 18 as best shown in FIG. 1. The tab nose 32 has a longitudinal re-enforcing groove 32*a* which is provided to enhance the rigidity thereof so that the tab 30** will not bend away during operation and use to rupture.

Figure 4:
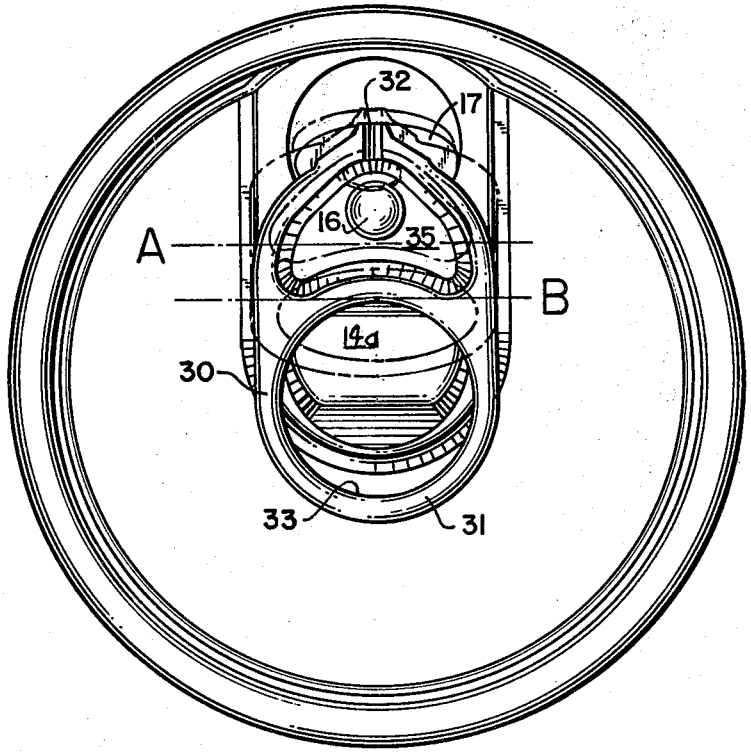

As already mentioned, the score line 18 is generally U-shaped with legs 19 bent inward toward one another and such terminating in a reverse outward curve. The legs 19 cant toward one another to facilitate the fold-back of the panel 17 as depicted in FIG. 4. That is to say that, after rupture the pulling on tab lift 31 by means of ring-pull opening 33 will first tip the ruptured portion of the displaceable panel 17 inwardly and then radially remove same transversely of the center panel 12 as tab 30 is pulled away from the wall 13 immediately adjacent the nose 32 of tab 30. Further pulling tends to fold the displaceable panel 17 back upon itself as it is torn along score line 18 and in particular up legs 19 to the reverse curve terminations. Thus, there is a first fold approximately at the line of the moustach score line 20 and a second fold at the hinge point, i.e., transversely across the mouth of the U-shape opening defined by score 18, the position of these folds is depicted by the lines labeled A and B respectively in FIG. 4. When the tab 30 is completely pulled back and the displaceable panel 17 is folded, the combination rests completely within the recess formed by the stepped wall 13 bounding the center panel 12.

In FIG. 3 the area adjacent the tab nose 32 is shown in an enlarged cross-section. Specifically, the step wall 13 is shown straight and unstepped and is labeled 36. This arrangement of leaving the offset 13*c* and the lower inwardly stepped wall portion 13*a* out of the area adjacent the tab nose 32 is important to enhancing the strength of the score line 18. In particular, the displaceable panel 17 is U-shape and has a bight portion immediately adjacent unstepped wall 36. That bight portion is such that the score line 18 defining it would fall nearly along the corner or juncture between wall 13 and center panel 12 were the wall stepped as it is throughout almost the entire circumference of the center panel 12. Therefore, in order to provide a relief or separation between the center panel 12 and its juncture with the surrounding wall 13, thus, the area surrounding the bight of the score line 18 is an unstepped wall 36. Between the score line 18 bight and the unstepped wall 36 there is shallow inwardly (of the container) recess 37 which is provided to act as a transition between a raised portion 14 and the bottom of the unstepped wall 36. This recess 37 is mostly composed of that part of inclined wall 15 for the raised portion 14.

During development of the described retained tab ring pull displaceable panel end closure 10, tests were run with and without the raised panel portion 14 and with and without the unstepped wall 36. The results of these tests showed that fatigue stress was significantly improved in terms of time and failure under alternate loadings of pressure and vacuum as a simulation of shipping. The aforesaid improvements permitted significant enhancement of abuse performance even though tests with heavier plate, cambered tabs or beads did not improve the performance. The essence of the test results show that the placement of the score line 18 (apart from the wall 36) was significant in improving fatigue resistance of the end. Moreover, the raised portion 14 supports the displaceable panel 17 in a plane above the general plane of the center panel 12 consequently inverted shipment loads are applied to the tab as well as the double seam preventing the flexure of the score line 18 during transit. Similarly, the slack metal in the recess 37 acts as a spring to held withstand loadings which would have otherwise been applied to the score line 18.

While a specific example has been shown and described in detail there the claims which follow that seek to cover the broad concept of the invention herein disclosed and claimed.

What is claimed is:

1. An easy open closure for a hollow cylindrical container body having at least one open end said closure comprising:

(a) a circular recessed central panel situated in a plane bounded by an outwardly stepped annular wall generally normal to said plane, (b) a peripheral flange atop said wall extending radially outward for joining said closure to one open end of said container body;

(c) a raised portion of said recessed panel offset to one side thereof and extending from said wall to about the middle of said recessed panel and said raised portion is in a plane slightly above the plane of said recessed central panel;

(d) an integral rivet formed within said raised portion;

(e) a displaceable panel in said raised portion disposed about said rivet and substantially defined by scoring;

(f) a ring pull tab having a tab nose and a tab lift with a central web therebetween and wherein said tab web is apertured to be joined to said displaceable panel by means of said rivet and said ring pull tab staked by said integral rivet with said tab nose near said wall and said tab lift near said middle, and (g) an unstepped portion of said wall in the area adjacent said tab nose.

2. The easy open closure of claim 1 wherein said raised portion is slightly larger in size then said tab and said plane of said portion is between the plane defined by said peripheral flange and said plane of said circular recessed central panel.

3. The easy open closure of claim 2 wherein said unstepped portion is adjacent said displaceable panel and said tab nose and forms a juncture between said recessed portion and said wall proximate said scoring of said displaceable panel.

4. The easy open closure of claim 3 wherein said displaceable panel scoring is generally U-shaped with the bight of said U-shaped scoring near said unstepped wall portion and the legs of said U-shaped scoring being angled toward each other at the mouth thereof and terminating in outwardly reverse curves being directed away from said mouth.

5. The easy open closure of claim 4 wherein said integral rivet is centered within said U-shaped scoring and includes a curvilinear line of weakness across the side of said rivet in said displaceable panel and facing toward the mouth of said U-shaped scoring and having a crescent shaped recessed portion for re-enforcing extending between the inside of said bight portion of said U-shaped scoring and said line of weakness so that crescent surrounds said integral rivet on one side and said line of weakness surrounds said integral rivet on the other side.

6. The easy open closure of claim 5 wherein said raised portion includes an anti-rotation means integrally thereto for engaging said tab lift and holding same against rotation about said rivet.

7. The easy open closure of claim 4 wherein said stepped wall is composed of a first lower section which is about one-half the total height of said stepped wall and an outwardly disposed upper section being about the other half of said wall height.

8. The easy open closure of claim 7 wherein said peripheral flange includes a downwardly and inwardly hooked edge for engaging a flange upon the one open end of the body.

* * * * *